US007228065B2

(12) United States Patent
Cafaro

(10) Patent No.: US 7,228,065 B2
(45) Date of Patent: Jun. 5, 2007

(54) GEM STONE METAL DRYER

(75) Inventor: Michael Cafaro, El Paso, TX (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 11/211,169

(22) Filed: Aug. 24, 2005

(65) Prior Publication Data

US 2007/0047930 A1 Mar. 1, 2007

(51) Int. Cl.
*A45D 20/10* (2006.01)
*A45D 20/12* (2006.01)

(52) U.S. Cl. ..... 392/385; 34/96

(58) Field of Classification Search ..... 392/385, 392/384, 383, 379; 34/283, 96; *A45D 20/12*
See application file for complete search history.

(56) References Cited

U.S. PATENT DOCUMENTS

| | | | | |
|---|---|---|---|---|
| 2,678,376 | A | 5/1954 | Lockwood | |
| 4,041,961 | A | 8/1977 | Shaler et al. | |
| 4,164,951 | A | 8/1979 | Shaler et al. | |
| D254,689 | S | 4/1980 | Neumark | |
| D277,789 | S | 2/1985 | Pajak | |
| D359,579 | S | 6/1995 | Mattis | |
| 5,507,103 | A | 4/1996 | Merritt | |
| D374,743 | S | 10/1996 | Viemeister et al. | |
| D428,528 | S | 7/2000 | Deguines | |
| D432,716 | S | 10/2000 | Goetschi | |
| 6,205,674 | B1 * | 3/2001 | Kaizuka | 34/96 |
| 6,378,225 | B1 | 4/2002 | Slingo | |
| 6,481,116 | B1 | 11/2002 | Slingo | |
| D470,975 | S | 2/2003 | Rizzuto, Jr. | |
| D470,976 | S | 2/2003 | Rizzuto, Jr. | |
| D472,345 | S | 3/2003 | Altamore et al. | |
| D472,672 | S | 4/2003 | Altamore et al. | |
| D473,341 | S | 4/2003 | Bokelman-Dumas | |
| 6,775,922 | B2 | 8/2004 | Langley et al. | |
| D496,754 | S | 9/2004 | Parodi | |
| 6,941,675 | B2 * | 9/2005 | Slingo | 34/96 |

FOREIGN PATENT DOCUMENTS

| | | |
|---|---|---|
| DE | 3404282 | 8/1985 |

* cited by examiner

*Primary Examiner*—Daniel Robinson
(74) *Attorney, Agent, or Firm*—Vinson & Elkins LLP

(57) ABSTRACT

A hair dryer that includes a nozzle with a plurality of concentric layers including an outer, protective layer, a perforated metal layer and an inner metal layer coated with gem stone powder wherein the gem stone layer is accessible through the perforations of the metal layer to provide a round styling appliance in addition to a blow dryer.

7 Claims, 4 Drawing Sheets

GEM STONE METAL DRYER

BACKGROUND OF THE INVENTION

The use of hand held hair dryers is common in beauty salons and in homes. The conventional dryer produces a flow of heated air that is directed onto the hair of a user for drying and styling. Improvements to hair dryers have also included heated ceramics to provide radiant heat and radiation to the hair of a user. Curling irons are also known for use as round styling appliances. A curling iron typically provides a curved heated surface and a tong for holding hair against the heated surface.

U.S. Pat. No. 6,205,674 describes a hair dryer in which the air passage includes a ceramic layer of mixed powder including both extreme infrared radiation material powder and poly-element minerals powder coating an interior wall of the cylinder designed to emit radiation into the air flow and out the air outlet.

U.S. Pat. No. 6,775,922 is another hair dryer in which one attachment is a nozzle for directing air flow axially. This nozzle includes a series of opening around the circumference and along the length of the nozzle to direct air in an axial direction, and further includes an end cap, preventing flow of air out the end of the nozzle as in a conventional hair dryer.

SUMMARY

The present disclosure can be described in certain embodiments as a hair dryer that includes a housing containing a motor and fan assembly for drawing ambient air into the housing through an air inlet and forcing the air through a tubular nozzle and out of the nozzle through an air outlet. The nozzle can be configured with the air outlet at the end of the nozzle furthest from the housing to direct a flow of heated or non-heated air onto the scalp hair of a user, or onto other objects in need of heat or drying. The tubular nozzle is constructed of concentric layers surrounding a central tubular opening that contains a heater assembly. The concentric layers can include an outer layer comprising ribs of a non heat conductive material; a middle, metal layer containing perforations; and an inner layer of metal coated on the outside with a powder comprising powdered gemstone. The powder can be a mixture of gemstone powders or a mixture of gemstone and ceramic powders. Certain embodiments employ jade or tourmaline powders, or a mixture of jade, tourmaline and ceramic. The gemstone powders are heated by the heater assembly and heat and radiation from the powders pass through the perforations in the metal layer, such that the nozzle provides a round hair styling appliance.

Throughout this disclosure, unless the context dictates otherwise, the word "comprise" or variations such as "comprises" or "comprising," is understood to mean "includes, but is not limited to" such that other elements that are not explicitly mentioned may also be included. Further, unless the context dictates otherwise, use of the term "a" may mean a singular object or element, or it may mean a plurality, or one or more of such objects or elements.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

The present disclosure can be described in certain aspects as a hair drying and hair styling appliance. The disclosed appliances have certain characteristics in common with a hand held hair dryer, or blow dryer. The appliances may include an air inlet, an air outlet, and a motor and fan assembly to force air from an air inlet through an outlet and onto the hair of a user, for example, although such appliances may also be used to dry objects or materials other than hair. The air is typically directed through a tube or nozzle in order to concentrate and direct the air flow, and such devices include a heater assembly that may be situated inside the tube or nozzle body, but is disposed so the air can be heated prior to being directed out of the air outlet. Some appliances also include a cold air feature in which un-heated air may be forced through the air outlet by the fan without activating the heating function.

In certain embodiments of the disclosure, the tubular nozzle is constructed of one metal nozzle over another metal nozzle. The first or inner metal nozzle is gem stone coated while the outer metal nozzle is perforated such that the gem stone coated inner metal nozzle may be visible and accessible through the outer metal nozzle. The gem stone coated inner metal nozzle is heated by the heater assembly situated inside the pair of metal nozzles. The metal nozzles may then be surrounded by plastic ribs to prevent a user from coming directly in contact or directly touching the metal nozzles. The present disclosure thus provides a unique hair drying and styling appliance that is both a blow dryer and a round, radiant styling device. The gem stone used to coat the inner metal barrel may include any of several different gem powders including jade, tourmaline, ruby, opal, sapphire, garnet, sapphire, or a combination and may include other powders such as crushed ceramic powder. In certain embodiments the inner metal nozzle is coated with from 10% to 90%, from 20% to 80%, from 30% to 70%, or from 40% to 60% gemstone powder, that may be a single gemstone or a combination of two or more. In certain embodiments the composition includes 30% jade powder, 30% tourmaline powder, and 40% ceramic powder.

Figure 1:
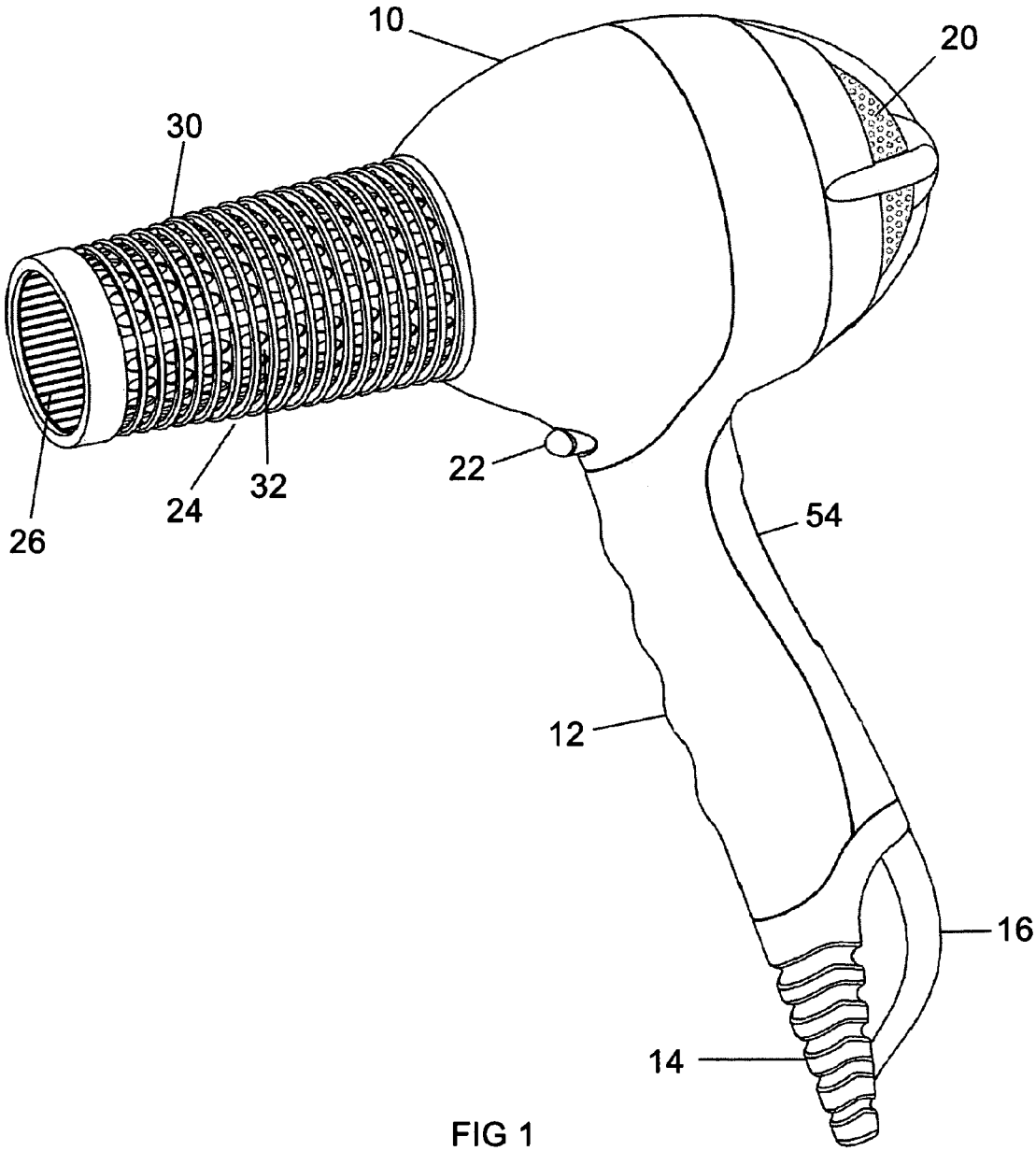
FIG. 1 is a perspective drawing of an embodiment of a hair dryer as disclosed.

An example of a hair drying/styling appliance is shown in FIG. 1. The appliance includes a body portion 10, and a handle portion 12. The handle portion includes a boot 14 for receiving an electric cord to supply power to the appliance. The handle also provides a loop 16, so the appliance can be hung on a hook for convenient storage. The handle may also provide finger recesses for improved grip and comfort during use.

As can also be seen in FIG. 1, the body portion 10 provides an air inlet 20 and provides space within the housing for the motor and fan. An indicator light 22 is also shown on the body portion to indicate the on/off status of the appliance.

A tube or nozzle 24 provides the an air outlet 26 and directs the flow of air from the body of the appliance. The nozzle includes an outer, protective layer 30 of a non-conductive such as a plastic or polymer material that does not conduct heat. This layer prevents contact of a users scalp or other area with a heated metal surface that might cause discomfort or even burned skin.

Figure 2:
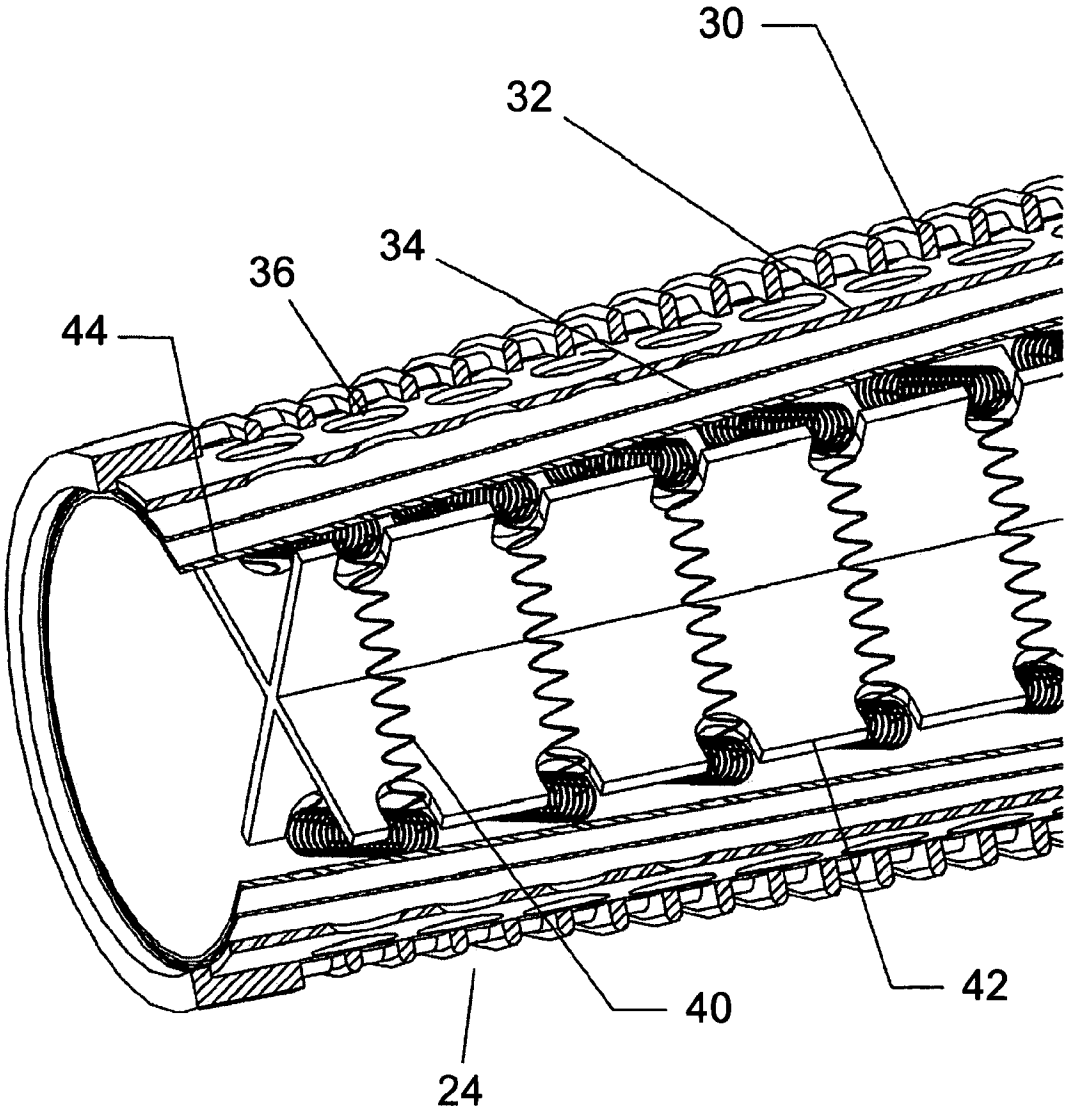
FIG. 2 is a cutaway drawing showing the concentric layers and heating element within the nozzle of an embodiment of a hair dryer as disclosed.

Underneath the outer, protective later 30, is a perforated metal layer 32. This layer can best be viewed in FIG. 2. Beneath the perforated layer 32 is a gemstone coated metal layer 34 that is accessible and visible by a user through the openings 36 in the perforated layer. In the interior of the three concentric layers or nozzles, there is a heater assembly. The heater assembly includes heater coils wrapped around a dielectric support 42. The dielectric support may be made of any suitable material and in certain embodiments is mica. The heater assembly also includes a liner 44, that may also be composed of mica.

Figure 3:
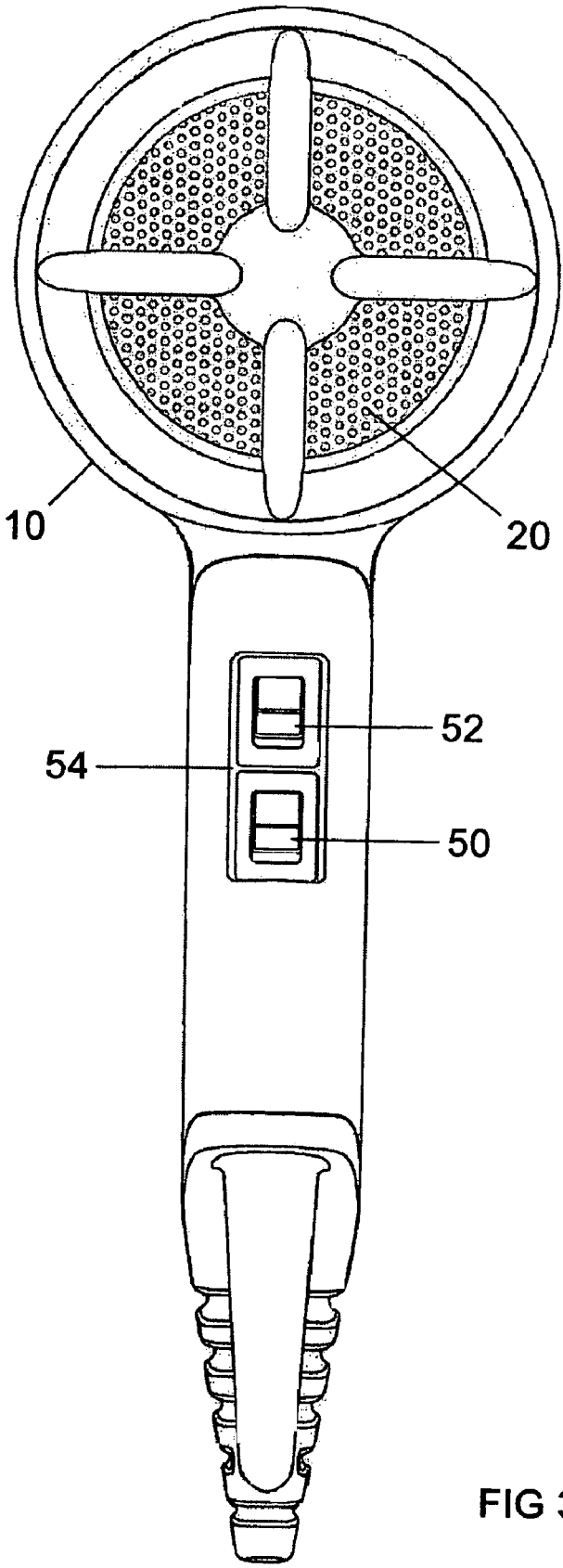
FIG. 3 is an elevation drawing of the rear of an embodiment of a hair dryer as disclosed.
Figure 4:
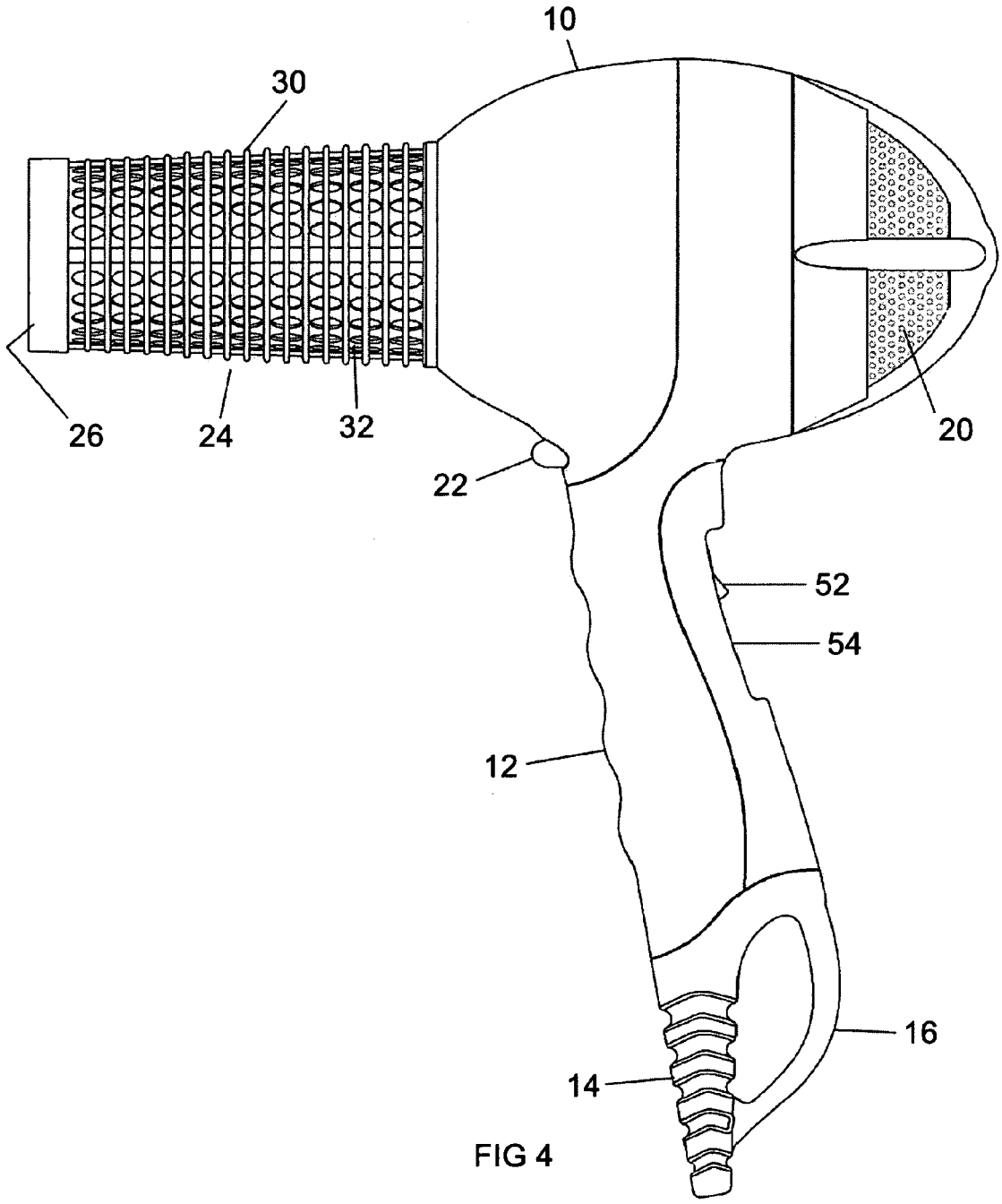
FIG. 4 is a side elevation drawing of an embodiment of a hair dryer as disclosed.

During use, a user connects the electric cord to a standard electrical plug to supply power to the appliance. The user may then press a power actuator button 52 in the handle as shown in FIG. 3, to supply power to the electric motor that drives the fan, or air impeller. In certain embodiments the fan speed may be adjusted from a low to high speed, either in a continuous range or the fan may be adjusted to stops such as "low," "medium," and "high." In this way the user may adjust the force of air that is drawn into the air inlets and forced out of the air outlet onto the hair of the user. In certain embodiments the appliance also comprises a second button or actuator 50 in the handle near the power button. The second button is an actuator for the heater assembly. The handle as shown includes recess portion 54, for the switch actuators, thus providing a unique advantage by eliminating the obstruction of the switch actuators during normal operation. The heater actuator allows the user to activate the heating assembly in the nozzle by sending electrical current to the heater coils of the heater assembly. The heater actuator may also have user adjustments such that the user can select a cooler or hotter temperature. The temperature adjustment may be continuous or the actuator may have stops such as "cool," "medium," and "hot." When the fan assembly and the heater assembly are both on, the air passing through the nozzle is heated for blowing heated air onto the hair of a user. In addition, the heater assembly transfers heat to the inner metal layer that is coated with gemstone powder or a combination of gemstone powder and ceramic powder. This heating causes the release of far infra red and other radiation that passes through the perforated metal layer and can be applied to the hair of a user. The nozzle of the present disclosure thus provides a unique radiant, round styling appliance for use in styling scalp hair.

The invention claimed is:

1. A hair dryer comprising:

a body comprising a motor connected to a fan configured to impel air into the body through one or more air inlets;

a tubular nozzle comprising a plurality of concentric layers, and providing a tubular opening connected to the body at one end thereof and providing an air outlet at the other end thereof, wherein the concentric layers comprise:

an outer layer comprising ribs of a non heat conductive material;

a middle layer of metal containing perforations disposed concentrically inside the outer layer; and an inner layer of metal coated on the outside with a powder comprising powdered gemstone and ceramic disposed concentrically inside the middle layer;

a heater assembly disposed in the tubular opening of the nozzle comprising a support, heater coils and a tubular liner disposed concentrically inside the coated layer; and a handle comprising a power actuator connected to an electrical cord and to the motor and an actuator connected to the electrical cord and to the heater assembly.

2. The hair dryer of claim 1, wherein the actuators are recessed into the handle.

3. The hair dryer of claim 1, wherein the heater support and liner are composed of mica.

4. The hair dryer of claim 1, wherein the coating comprises jade and tourmaline powders.

5. The hair dryer of claim 1, wherein the coating consists of 30% jade powder, 30% tourmaline powder, and 40% ceramic powder.

6. A hair styling appliance comprising:

a body, a tubular nozzle connected to the body and a handle connected to the body;

a motor and fan assembly at least partially contained in the body and configured to impel air into the body through one or more air inlets and from the body through the nozzle and out of the nozzle through one or more air outlets when activated;

a heater assembly disposed at least partially within the nozzle, configured to heat air passing through the nozzle;

wherein the tubular nozzle comprises a plurality of concentric layers, including an outer layer comprising ribs of a non heat conductive material; a middle layer of metal containing perforations; and an inner layer of metal coated on the outside with a powder comprising a mixture of powdered gemstone and ceramic;

wherein the gemstone coated layer is heated by the heater assembly to provide a heated, tubular hair styling appliance.

7. The hair styling appliance of claim 6, wherein the outside surface of the inner layer of metal is coated with 30% jade powder, 30% tourmaline powder, and 40% ceramic powder.

* * * * *